US007066287B2

(12) United States Patent
Lin

(10) Patent No.: US 7,066,287 B2
(45) Date of Patent: Jun. 27, 2006

(54) MUD DEBRIS DIVERTER FOR EARTH-BORING BIT

(75) Inventor: Chih C. Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 135 days.

(21) Appl. No.: 10/780,389

(22) Filed: Feb. 17, 2004

(65) Prior Publication Data

US 2005/0178588 A1 Aug. 18, 2005

(51) Int. Cl.
*E21B 10/22* (2006.01)

(52) U.S. Cl. ..... 175/371

(58) Field of Classification Search ..... 175/313, 175/371, 372, 331; 384/94
See application file for complete search history.

(56) References Cited

U.S. PATENT DOCUMENTS 2,769,616 A 11/1956 Morlan et al.
2,960,313 A 11/1960 Goodwin
3,013,621 A 12/1961 Kinnear
4,223,749 A 9/1980 Bodine et al.
4,515,228 A 5/1985 Dolezal et al.
5,056,610 A 10/1991 Oliver et al.
5,358,061 A 10/1994 Nguyen
5,644,956 A * 7/1997 Blackman et al. ..... 76/108.2
5,740,871 A 4/1998 Williams
6,533,051 B1 3/2003 Singh et al.

* cited by examiner

*Primary Examiner*—Kenneth Thompson
(74) *Attorney, Agent, or Firm*—Bracewell & Giuliani LLP

(57) ABSTRACT

A rolling cone earth boring bit has a diverter located between the bit leg and the back face of the cone to divert debris from the seal gland area. The diverter has a base that inserts into a hole in a last machined surface of the bit. The diverter has a head that is wedge-shaped and protrudes from the hole into a clearance between the back face and the last machined surface. The head has an inner side that is spaced from an annular wall of the back face by a small uniform clearance. The head has an outer side that is oblique to the annular wall of the back face region to divert debris from the clearance.

20 Claims, 3 Drawing Sheets

MUD DEBRIS DIVERTER FOR EARTH-BORING BIT

FIELD OF THE INVENTION

The invention relates in general to earth boring bits, and in particular to a diverter located between the bit leg and the back face for diverting debris from the seal area of the cone.

BACKGROUND OF THE INVENTION

A typical rolling cone earth boring bit has a bit body with three legs. Each bit leg has a bearing pin that extends downward and inward. A cone mounts on the bearing pin, the cone having a back face that is closely spaced to a last machined surface on the bit leg. A seal located in a seal gland near the last machined surface seals lubricant within the bearing spaces between the cone and the bearing pin.

While drilling, cuttings and other debris flow around the bit. In some cases, the cuttings tend to migrate into the clearance between the back face and the last machined surface. The debris enters the seal area, resulting in wear to the seal and possibly premature bearing failure.

In the prior art, deflecting pins have been mounted in holes in the last machined surfaces. These pins are closely spaced to the back face of the cone for retarding entry of debris into the seal gland area. While workable, improvements are desired.

SUMMARY OF THE INVENTION

In this invention, at least one diverter is mounted in a hole in the bit leg, the diverter having a protruding head that is located adjacent to the back face region. The head is generally wedge-shaped, with a more pointed end facing into the direction of rotation of the cone. The diverter head has an inner side that is generally perpendicular to a radial line emanating from the axis of the bearing pin. The diverter head has an outer side that is at an acute angle relative to the inner side.

The back face region of the cone has inner and outer portions that are flat and perpendicular to the axis of the bearing pin. An annular wall separates the inner and outer portions. The outer portion is spaced by a larger clearance from the last machined surface than the inner portion. The head of the diverter locates in the larger clearance with the inner side of the head closely spaced to the annular wall. The inner side is shaped to substantially follow the contour of the annular wall in a preferred embodiment.

DETAILED DESCRIPTION OF THE INVENTION

Figure 1:
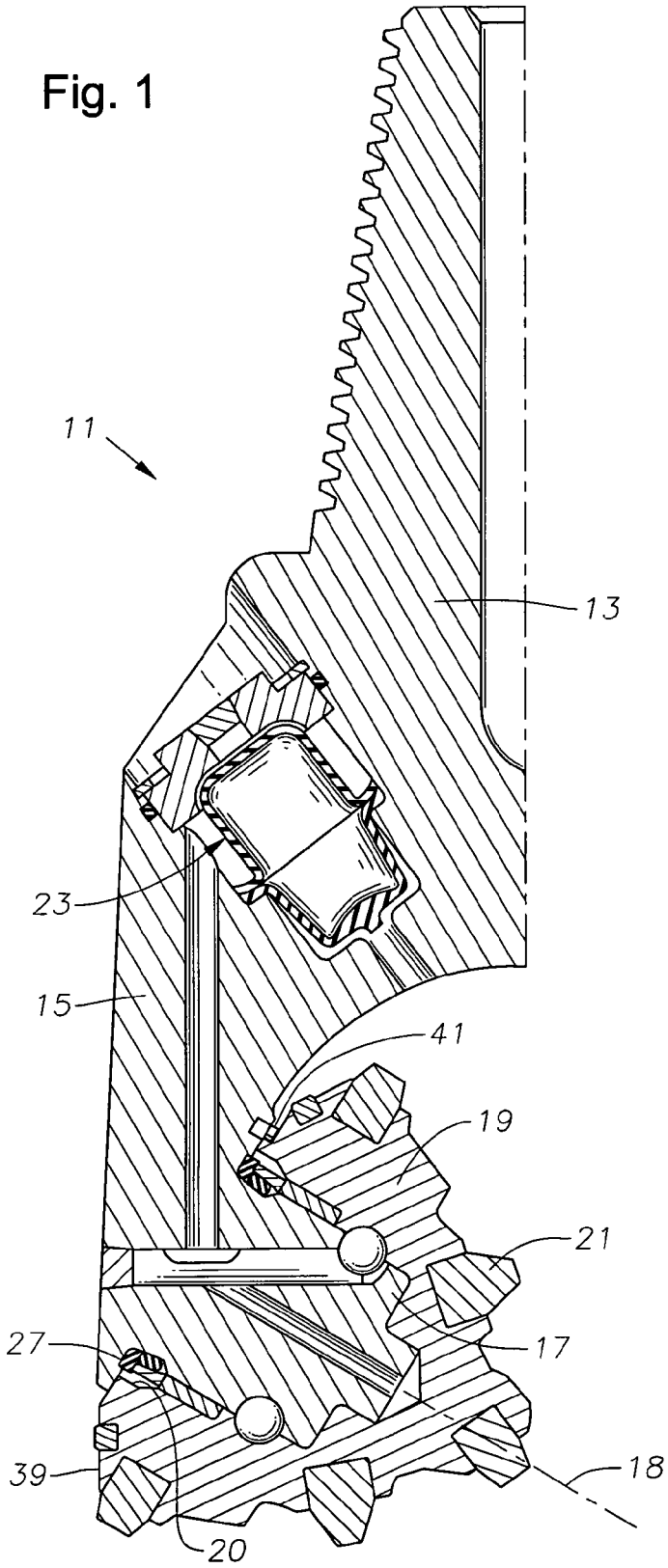
FIG. 1 is a vertical sectional view of a portion of a drill bit constructed in accordance with this invention.

Referring to FIG. 1, bit 11 has a body 13 with at least one bit leg 15. Typically, there are three of the bit legs 15. Each bit leg 15 has a bearing pin 17 that extends downward along a bearing pin axis 18 toward an axis of rotation of body 13. A cone 19 with a central cavity 20 mounts rotatably on bearing pin 17, which has a journal bearing surface. Cone 19 has a plurality of cutting elements 21. Cuttings elements 21 may be either hard metal inserts inserted into mating holes as shown, or milled teeth formed on the exterior of cone 19.

Each leg 15 has a pressure compensator 23 and lubricant passages 25 that lead to the journal bearing surfaces between cone 19 and bearing pin 17. Pressure compensator 23 reduces pressure differential between the hydrostatic pressure of the drilling fluid in the well and the pressure of the lubricant in lubricant passage 25. An annular seal 27 is located at the base of bearing pin 17 for sealing the lubricant within the journal bearing. As shown, seal 27 comprises two metal face seal rings and an elastomer energizer, however, seal 27 could be of many different types.

Figure 2:
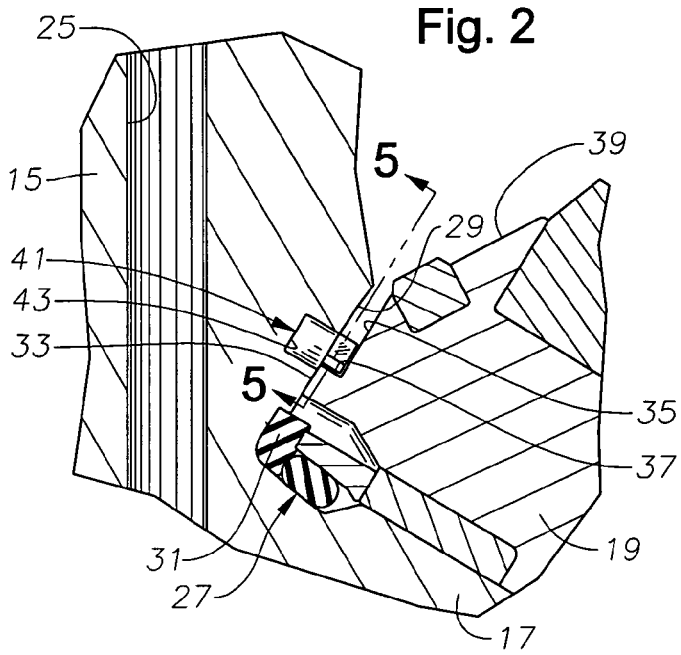
FIG. 2 is an enlarged vertical sectional view of a last machined surface of the bit leg and a back face region of the cone of the drill bit of FIG. 1, showing a diverter member in accordance with the invention.

Referring to FIG. 2, seal 27 is located within an annular seal gland 31 that is partially on bearing pin 17 and partially on bit leg 15. A last machined surface 29 on bit leg 15 borders seal gland 31 and extends radially outward therefrom relative to bearing pin axis 18 (FIG. 1). In this embodiment, seal gland 31 comprises an annular recess. Last machined surface 29 is a flat surface located in a plane perpendicular to axis 18 (FIG. 1) of bearing pin 17.

In this embodiment, cone 19 has a flat inner back face portion 33 beginning at cavity 20 and extending outward perpendicular to axis 18 of bearing pin 17. An outer back face portion 35 joins inner back face portion 33. Outer back face portion 35 is also flat and perpendicular to axis 18 (FIG. 1) of bearing pin 17, however it is spaced axially from inner back face portion 33, relative to axis 18. An annular wall 37 is located at the junction of inner back face portion 33 with outer back face portion 35, wall 37 preferably being cylindrical. Alternately, wall 37 could be conical or tapered. The clearance between inner back face portion 33 and last machined surface 29 is smaller than the clearance between outer back face portion 35 and last machined surface 29. In this embodiment, outer back face portion 35 extends outward to a gage surface 39. Gage surface 39 is a conical surface that governs the outer diameter of the hole being drilled.

Figure 3:
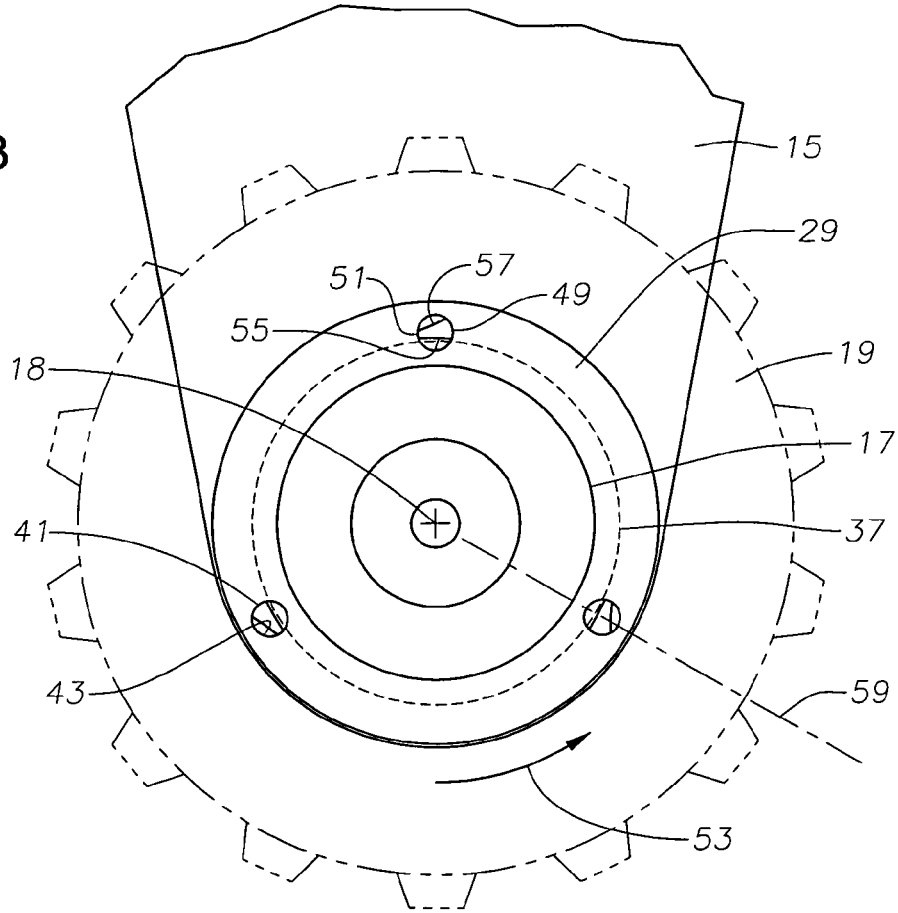
FIG. 3 is an end view of an inner end of the bearing pin on which the cone of FIG. 2 is supported, the cone being shown by dotted lines.

At least one, and preferably a plurality of diverters 41 are mounted to last machined surface 29. As shown in FIG. 3, each diverter 41 is circumferentially spaced from the others. In the embodiment shown, each diverter 41 is located approximately 120 degrees apart from the other relative to bearing pin axis 18 (FIG. 1). Referring again to FIG. 2, each diverter 41 has a base 45 that is interferingly pressed into a hole 43 formed in last machined surface 29. Base 45 is cylindrical and preferably has a top surface that is substantially flush with last machined surface 29. Hole 43 is located so that part of diverter base 45 is located in the smaller clearance area between last machined surface 29 and inner back face portion 33. The innermost portion of diverter base 45 is closer to bearing pin axis 18 than annular wall 37. The outermost portion of diverter base 45 is in a part of the larger clearance between last machined surface 29 and outer back face portion 35.

Figure 4:
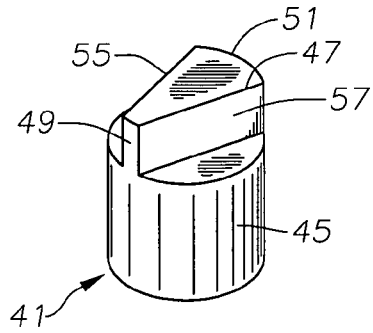
FIG. 4 is a perspective view of the diverter member shown in the sectional view of FIG. 2.

A head 47 integrally formed on the top of base 45 protrudes into the clearance between last machined surfaced 29 and outer back face portion 35. As shown also in FIGS. 3–5, head 47 is wedge or triangular-shaped in a transverse cross-section perpendicular to an axis of base 45. Head 47 has a leading side 49 that forms a point or sharper end of head 47, and a trailing side 51 that is 180 degrees from leading side 49. Leading side 49 points into the direction of rotation of cone 19, as indicated by arrow 53 in FIG. 3. Leading side 49 is not a sharp point in the first embodiment, but it is considerably narrower than trailing side 51. Leading side 49 and trailing side 51 are curved at the same radius as base 45 in this embodiment. The distance from leading side 49 to trailing side 51 is the same as the diameter of base 45 in this embodiment.

Figure 5:
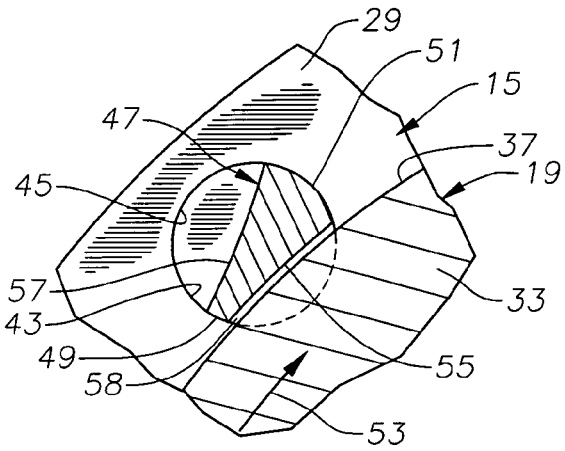
FIG. 5 is a sectional view of the diverter member of FIG. 2, taken along the line 5—5 of FIG. 2.

Head 47 also has an inner side 55 and an outer side 57. Inner side 55 is located next to back face annular wall 37. Inner side 55 is offset from and parallel to a diametrical line in the embodiment of FIG. 5. Inner side 55 and outer side 57 diverge from each other at an angle that is preferably in the range from about 30 to 45 degrees. As shown in FIG. 5, in this first embodiment, outer side 55 is slightly concave, although it could be straight as well. Inner side 55 is also slightly concave at preferably a radius slightly larger than the radius of curvature of back face annular wall 37. Making inner side 55 parallel to a portion of back face annular wall 37 results in a substantially uniform width clearance 58 between diverter head inner side 55 and back face annular wall 37. Clearance 58 extends from leading side 49 to trailing side 51. A radial line 59 (FIG. 3) emanating from bearing pin axis 18 passes through head 47 normal to inner side 55 and at an oblique angle relative to outer side 57. Inner side 55 is substantially perpendicular to radial line 59 even though it is slightly concave.

In the operation of the first embodiment, cone 19 rotates in the direction indicated by arrow 53 in FIG. 3 during normal drilling operations. Debris flows in the larger clearance between last machined surface 29 and back face portion 35 (FIG. 2). This debris tends to rotate with cone 19. When the debris contacts diverter head 47, outer side 57 diverts the debris away from back face annular wall 37 and thus away from the area of seal gland 31 (FIG. 2).

Figure 6:
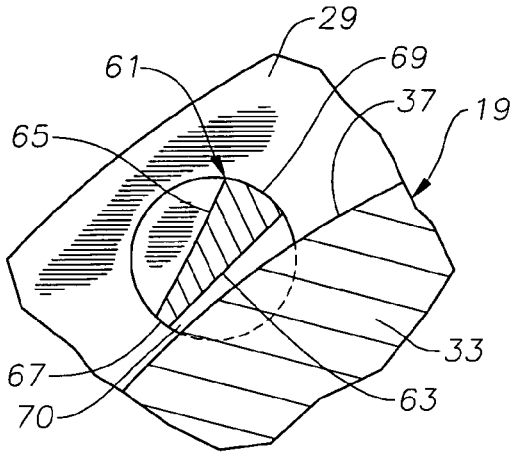
FIG. 6 is a sectional view similar to FIG. 5 but showing an alternate embodiment of the diverter member.

While it is preferred to have a diverter head that is wedge-shaped, the configuration of the head can vary, as indicated in FIGS. 6–9. The components of the alternate embodiments that are the same as in the first embodiment have the same reference numerals as the first embodiment. In FIG. 6, as in all of the embodiments, diverter head 61 has a more pointed leading side 67 and a blunter trailing side 69, defining a wedge shape. In this embodiment, inner side 63 is straight, rather than being slightly concave as inner side 55 of the first embodiment. Inner side 63 is substantially perpendicular to radial line 59 (FIG. 2) and is located substantially on a diametrical line in this embodiment. Inner side 63 as shown is not precisely parallel to a tangent line of annular wall 37, although it could be. Rather, inner side 63 is shown at a slight angle to a tangent line of annular wall, resulting in a clearance 70 that is slightly narrower at leading side 67 than at trailing side 69. In this embodiment, outer side 65 is slightly concave in the same manner as outer side 57 of the embodiment of FIG. 5.

Figure 7:
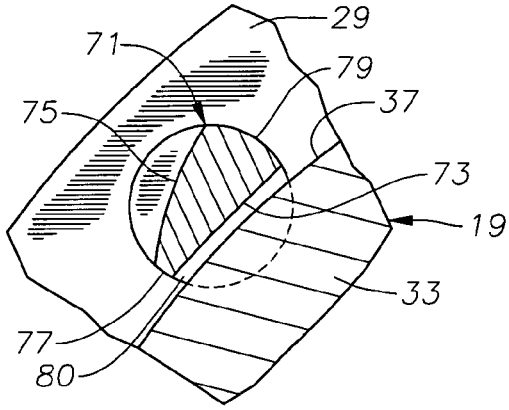
FIG. 7 is a sectional view similar to FIG. 5 but showing another alternate embodiment of the diverter member.

Referring to FIG. 7, in this embodiment, diverter head 71 is also wedge-shaped. Inner side 73 is flat, similar to inner side 63 of the FIG. 6 embodiment, but it could be concave if desired. Inner side 73 is substantially perpendicular to radial line 59 (FIG. 3), although slightly angled as in the FIG. 6 embodiment. In the FIG. 7 embodiment, outer side 75 is convex. Leading side 77 is blunter than the other embodiments, but still sharper or narrower than trailing side 79. Clearance 80 has a minimum width at leading side 77 and diverges toward trailing side 79.

Figure 8:
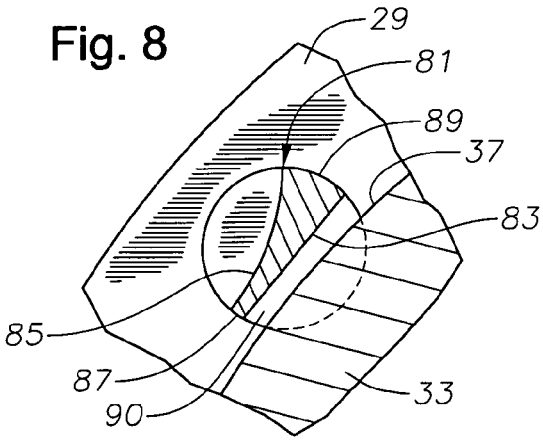
FIG. 8 is a sectional view of the diverter member of FIG. 5 but showing another embodiment of the diverter member.

In the embodiment of FIG. 8, diverter head 81 has a flat inner side 83 and an outer side 85 that is considerably move concave than in FIG. 6. Leading side 87 is much narrower than trailing side 89 as in the other embodiments. Inner side 83 is perpendicular to radial line 59 (FIG. 3), thus it is parallel to a tangent line of annular wall 37. Inner side 83 is located substantially on a diametrical line. Clearance 90 has its minimum width midway between leading side 87 and trailing side 89. The widths of clearance 90 at leading side 87 and trailing side 89 are the same. Although clearance 90 converges to a lesser width in a direction from leading side 87 toward trailing side 89, a significant nip area is not created at the minimum width location because of the much greater diameter of annular wall 37 than the diameter of the cylindrical base of diverter head 81.

Figure 9:
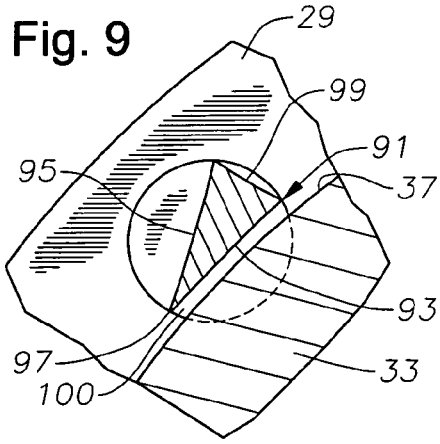
FIG. 9 is a sectional view similar to FIG. 5, but of another embodiment of the diverter member.

In the embodiment of FIG. 9, diverter head 91 has flat inner side 93, a flat outer side 95, a sharp leading side 97 and a truncated flat trailing side 99. Inner side 93 is perpendicular to radial line 59 (FIG. 3) in the same manner as in the embodiment of FIG. 7. As in the embodiment of FIG. 7, clearance 100 has its minimum width midway between leading side 97 and trailing side 99.

The invention has significant advantages. The wedge-shaped diverter head deflects drilling cuttings and debris away from the seal gland area. The narrow clearance between the inner side of the diverter head and the annular wall avoids a nip area that could otherwise draw debris between the head and the annular wall.

While the invention has been shown in only five of its forms, it should be apparent to those skilled in the art that it is not so limited but is susceptible to various changes without departing from the scope of the invention. For example, a concave outer side could be used with either a flat or a concave inner side. A convex outer side could be used with either a flat or concave inner side. Also, the diverter head could locate within an annular groove formed in the backface.

The invention claimed is:

1. An earth boring drill bit, comprising:

a body having at least one leg with a bearing pin having an axis and depending therefrom;

a cone rotatably mounted on the bearing pin, the cone having a back face region having an annular wall spaced radially outward from a seal gland, the annular wall facing outward relative to the axis; and a diverter having a head extending alongside the annular wall of the back face region, the head being generally wedge-shaped and facing into the direction of rotation of the cone to divert debris from the seal gland.

2. The drill bit according to claim 1, wherein the head of the diverter has an inner side that substantially follows a contour of the annular wall of the back face region.

3. The drill bit according to claim 1, wherein the head of the diverter has an inner side that is spaced from the annular wall of the back face region by a substantially uniform width clearance.

4. The drill bit according to claim 1, wherein the head of the diverter has an inner side that is substantially perpendicular to a radial line emanating from the axis of the bearing pin.

5. The drill bit according to claim 1, wherein the head of the diverter has an inner side and an outer side that diverge from each other.

6. The drill bit according to claim 1, wherein the head of the diverter has an inner side and an outer side, wherein the inner side generally follows a contour of the annular wall, and the outer side is oblique relative to the annular wall.

7. The drill bit according to claim 1, wherein the head of the diverter has a leading side and a trailing side, the trailing side having a greater width than the leading side.

8. The drill bit according to claim 1, wherein the head of the diverter has an inner side and an outer side that diverge from each other at an acute angle.

9. The drill bit according to claim 1, wherein the diverter has a cylindrical base that locates within a hole formed in the bit leg, the base having an innermost portion that is spaced closer to the axis of the bearing pin than the annular wall of the back face region.

10. An earth boring drill bit, comprising:

a body having at least one leg with a bearing pin depending therefrom and a last machined surface surrounding a junction of the bit leg and the bearing pin, the last machined surface being perpendicular to an axis of the bearing pin;

a cone rotatably mounted on the bearing pin, the cone having a back face region with a flat inner portion and a flat outer portion separated by an annular wall, the flat inner portion being parallel to and spaced from the last machined surface by an inner clearance, the flat outer portion being parallel to and spaced from the last machined surface by an outer clearance that is greater than the inner clearance; and a diverter having a base mounted in a hole in the last machined surface of the bit and a head protruding from the hole into the outer clearance, the head having an inner side that is spaced from the annular wall of the back face region by a clearance, the head having an outer side that is oblique to the annular wall of the back face region to divert debris from the inner clearance.

11. The bit according to claim 10, wherein the head of the diverter has a leading side and a trailing side relative to the direction of rotation of the cone, and wherein the leading side has a lesser width, measured along a radial line from the axis of the bearing pin, than the trailing side.

12. The bit according to claim 10, wherein the inner and outer sides of the head diverge from each other from a leading side to a trailing side of the diverter relative to a direction of rotation of the cone.

13. The bit according to claim 10, wherein the head has a leading side and a trailing side relative to the direction of rotation of the cone, and wherein a distance from the leading side to the trailing side is the same as a diameter of the base of the diverter.

14. The bit according to claim 10, wherein the inner side of the head has a length substantially equal to a diameter of the base.

15. The bit according to claim 10, wherein the base is of the diverter has an inner portion that is spaced closer to the axis of the bearing pin than the annular wall of the back face region.

16. An earth boring drill bit, comprising:

a body having at least one leg with a bearing pin having an axis and depending therefrom;

a cone rotatably mounted on the bearing pin, the cone having a back face spaced from the bit leg by a clearance, the back face having a cylindrical wall that faces outward relative to the axis; and a diverter having a base mounted in a hole in the bit leg and a head protruding therefrom alongside and radially outward from the cylindrical wall in the clearance between the back face and the bit leg, the head having a leading side and a trailing side considering the direction of rotation of the cone, the leading side being of a narrower width than the trailing side, measured along a radial line emanating from the axis of the bearing pin, to divert debris away from the clearance.

17. The bit according to claim 16, wherein a distance from the leading side to the trailing side is substantially equal to a diameter of the base.

18. The bit according to claim 16, wherein the head has an inner side adjacent to the cylindrical wall and an outer side, and wherein a radial line from the axis of the bearing pin passes obliquely through the outer side.

19. The bit according to claim 16 wherein the head has an inner side adjacent to the cylindrical wall and an outer side, and wherein the inner side is generally perpendicular to a radial line from the axis of the bearing pin.

20. An earth boring drill bit, comprising:

a body having at least one leg with a bearing pin depending therefrom;

a cone rotatably mounted on the bearing pin, the cone having a back face spaced from the bit leg by a clearance;

a diverter having a base mounted in a hole in the bit leg and a head protruding therefrom in the clearance between the back face and the bit leg, the head having a leading side and a trailing side considering the direction of rotation of the cone, the leading side being of a narrower width than the trailing side, measured along a radial line emanating from an axis of the bearing pin, to divert debris away from the clearance; and wherein the head is generally triangular shaped viewed in a cross-section perpendicular to an axis of the base.

* * * * *